US010362906B2

(12) United States Patent
Papageorge et al.

(10) Patent No.: US 10,362,906 B2
(45) Date of Patent: Jul. 30, 2019

(54) BATHTUB INSERT AND METHODS OF MAKING AND USING SAME

(71) Applicants: Ryan G Papageorge, Shelton, CT (US); Li Papageorge, Shelton, CT (US)

(72) Inventors: Ryan G Papageorge, Shelton, CT (US); Li Papageorge, Shelton, CT (US)

(73) Assignee: Cozy Mouse LLC, Shelton, CT (US)

( * ) Notice: Subject to any disclaimer, the term of this patent is extended or adjusted under 35 U.S.C. 154(b) by 14 days.

(21) Appl. No.: 15/389,093

(22) Filed: Dec. 22, 2016

(65) Prior Publication Data

US 2018/0177346 A1 Jun. 28, 2018

(51) Int. Cl.
*A47K 3/12* (2006.01)
*A47K 3/024* (2006.01)

(52) U.S. Cl.
CPC ..... *A47K 3/127* (2013.01); *A47K 3/024* (2013.01)

(58) Field of Classification Search
CPC ..... A47D 15/005; A47K 3/127
USPC ..... 4/572.1
See application file for complete search history.

(56) References Cited

U.S. PATENT DOCUMENTS 5,361,430 A 11/1994 Wise
7,065,805 B1 6/2006 Sundberg
7,412,732 B1 * 8/2008 Leonard ..... E03D 9/00 4/300.3
2007/0033727 A1 * 2/2007 Liu ..... A47K 3/024 4/572.1
2008/0086804 A1 * 4/2008 Goh Aow ..... A47K 3/127 4/300
2014/0201901 A1 7/2014 Gibree
2014/0259359 A1 * 9/2014 Yaari ..... A47K 3/064 4/546
2014/0335492 A1 * 11/2014 Braaten ..... A63B 69/18 434/253
2014/0345042 A1 11/2014 Morand

FOREIGN PATENT DOCUMENTS

CN 2307493 Y 2/1999

OTHER PUBLICATIONS

Toys "R" Us, Fisher-Price Aquarium Bath Center, 7 pages (printed Nov. 12, 2015).
Toys R Us, Babies R Us Folding Bath Sling with Warming Wings—Garden, 3 pages (printed Nov. 12, 2015).
Quik Solve, Baby Bathtub Seat Support Sling Hammock Net Infant Bath Tub Sponge Pad Insert, 7 pages (printed Nov. 12, 2015).
(Continued)

*Primary Examiner* — Christine J Skubinna
(74) *Attorney, Agent, or Firm* — UConn IP Law Clinic; Matthew Burton; Sean Paquette

(57) ABSTRACT

A bathtub insert is described herein that includes a bathtub shell that with a back support, and opposite first and second walls connected to the back support. A front support is connected to the bathtub shell. The front support includes a belt portion that has first and second ends mounted to the shell, and a downwardly extending support portion that includes a comfort opening and a cover configured to cover at least a part of the comfort opening. A strap for a bathtub insert is also disclosed, along with methods for using the bathtub insert and strap to support a baby for a bath.

13 Claims, 14 Drawing Sheets

(56) References Cited

OTHER PUBLICATIONS

Comfort & Harmony, Bring Starts Playful Pinwheels Bouncer, 5 pages (printed Nov. 12, 2015).
My Little Seat, Infant Travel High Chair, Hula Lopps, 6 Months, 7 pages (printed Nov. 12, 2015).
Summer Infant, Bath Sling with Warming Wings, 7 pages (printed Nov. 12, 2015).
The First Years, Sure Comfort Deluxe Newborn to Toddler Tub, Blue, 9 pages (printed Nov. 12, 2015).

* cited by examiner

BATHTUB INSERT AND METHODS OF MAKING AND USING SAME

BACKGROUND

The embodiments disclosed herein are generally directed to the field of baby bathtubs and infant care.

Baby bathtubs are designed to make it manageable to bathe an infant. They are designed to create an environment to allow parents to bathe their child in a small space that fits the baby's size. Baby bathtubs are usually designed to allow the baby to lie down in the bathtub with the head and legs supported, as well as to let the bather use minimal water and not submerge the infant in an unmanageable amount of water. This is best achieved by keeping the baby in a shallow enclosure using minimal water and soap. These devices are usually rigid, plastic, and roughly the size of a bassinet. This rigid construction is good for durability but makes the device very slippery and uncomfortable for the infant inside of the baby bathtub. Because of this, the baby often moves around and slips in the bathtub, making it difficult for the bather to finish the process. Another problem that bathers of infants experience is infant excretion. As most babies do not yet have control of their bladders, they may disrupt the bathing process with urination.

There exists a need in the art to overcome the deficiencies and limitations of infant bathtubs described herein and above.

SUMMARY

One embodiment described herein is a bathtub insert comprising a bathtub shell including a back support, and opposite first and second walls connected to the back support. A front support is connected to the bathtub shell. The front support includes a belt portion having first and second ends mounted to the shell, a downwardly extending support portion including a comfort opening, and a cover configured to cover at least a part of the comfort opening.

Another embodiment described herein is a bathtub strap with a front support including a belt portion having a length, first and second ends configured to be attached to an infant bathtub or a bathtub insert, and an extension portion having an inner end portion connected to the front support and an outer end portion including a comfort opening. Additional features and advantages are realized through the techniques of the embodiments described herein.

The recitation herein of desirable objects which are met by various embodiments is not meant to imply or suggest that any or all of these objects are present as essential features, either individually or collectively, in the most general embodiment or in any of its more specific embodiments.

BRIEF DESCRIPTION OF THE DRAWINGS

The disclosed embodiments, both as to organization and method of practice, together with the further objects and advantages thereof, may best be understood by reference to the following description taken in connection with the accompanying drawings in which.

DETAILED DESCRIPTION

The baby bathtub insert is designed to secure a baby during bathing and create a buffer to mitigate the effects of infant urination and increase the baby's comfort. The baby bathtub insert makes it possible to secure the baby in the bathtub during bathing by including a leg strap with the bathtub insert. The strap also limits messiness during the bathing process by integrating a cover that blocks possible urine excretion. In embodiments, the insert comprises a soft and water resistant or waterproof interior surface to make the infant comfortable during the bathing process.

As used herein, the term "back support" means a support configured to contact a baby's back during bathing. As used herein the term "front support" means a support configured to hold a baby in place during bathing. As used herein, the term "comfort opening" means an opening in the front support configured to allow room for a baby's private area.

Figure 1:
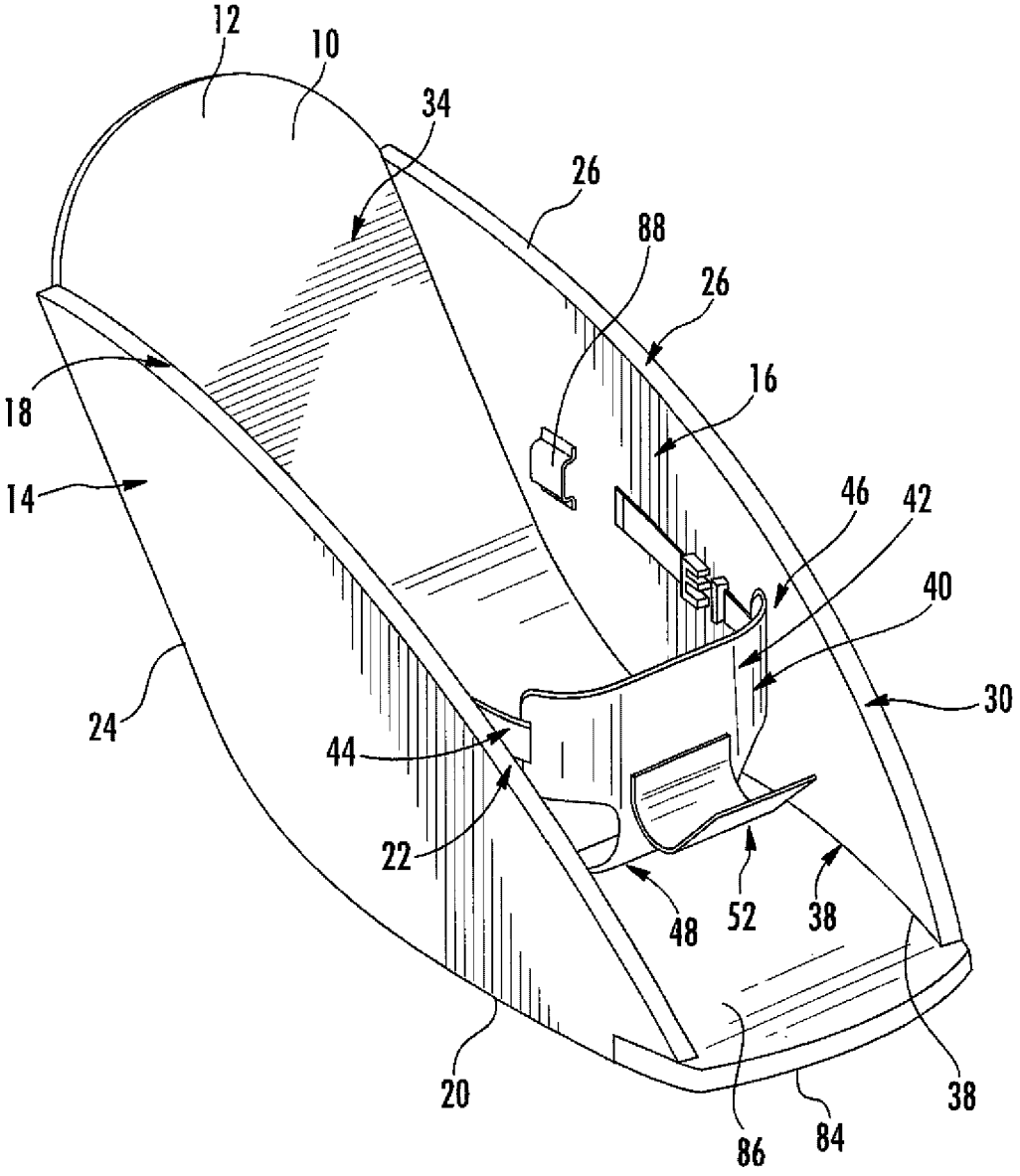
FIG. 1 shows a perspective view of one embodiment of a bathtub insert described herein.
Figure 2:
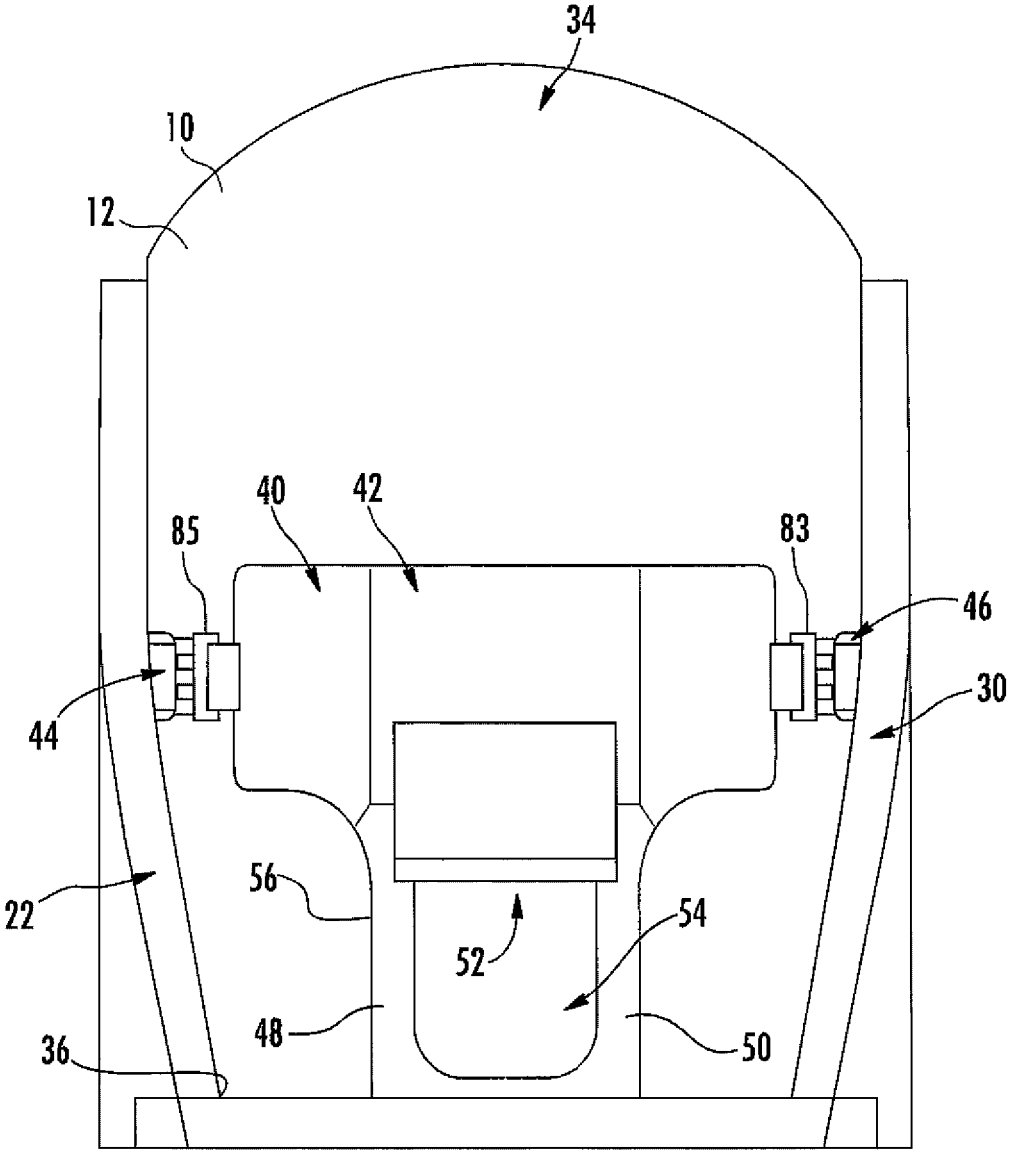
FIG. 2 shows a front view of the embodiment shown in FIG. 1.
Figure 3:
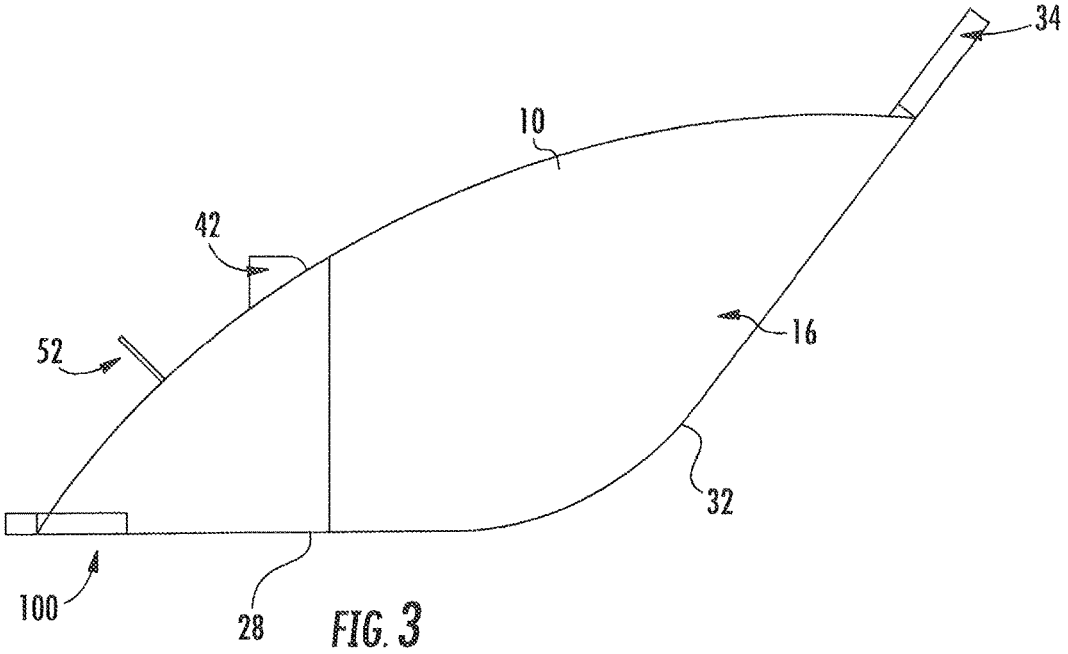
FIG. 3 illustrates a side view of the embodiment of FIG. 1.

FIGS. 1-3 show a bathtub insert 10 having a bathtub shell structure 12. The shell structure 12 is water resistant or waterproof and configured to contain fluids during the bathing process. The shell structure 12 includes a back support 34 and first and second walls 14, 16 connected to the back support 34. The first wall 14 has a top edge 18, a bottom edge 20, a front edge 22, and a back edge 24. The second wall 16 has a top edge 26, a bottom edge 28, a front edge 30, and a back edge 32. The back support 34 has a first edge 36 and a second edge 38. The back support 34 is configured to support the bather comfortably during the bathing process. The first edge 36 of the back support 34 is connected to the bottom edge 28 and the back edge 24 of the first wall 14. The second edge 38 of the back support 34 is connected to the bottom edge 28 and the back edge 32 of the second wall 16. In embodiments the back edge 24 is continuous with the bottom edge 20 of the first wall 14. In embodiments the back edge 32 is continuous with the bottom edge 28 of the second wall 16.

FIGS. 1-3 further show a front support 40 configured to support the front of a baby during bathing, usually around the stomach and/or belly area. The front support 40 includes a belt portion 42, having a first end 44 and a second end 46. In the embodiment shown, the first end 44 of the belt portion 42 connects to the first wall 14 and the second end 46 of the belt portion 42 connects to the second wall 16. The figures further show the front support 40 having a downwardly extending support portion 56 to connect the belt portion 42 to the back support 34. The downwardly extending support portion 56 includes a central comfort opening 54, a first extension 48 and a second extension 50, both of which extend downwardly on opposite sides of the comfort opening 54. A cover 52 is mounted near the comfort opening 54 and is configured to cover at least a part of the comfort opening 54 in order to downwardly deflect urine during bathing. The comfort opening 54 also aids in cleaning the baby's private areas. The front support 40 supports the belly of a baby for comfort and safety. The downwardly extending support portion 56 fits between the legs of the infant and functions as a safety strap to prevent the infant from sliding downwardly in the bathtub insert 10. The connection of the downwardly extending support portion 56 with the back support 34, combined with the side connections of the first end 44 and second end 46 of the belt portion 42 to the first and second walls, 14, 16, respectively, provide a safe and comfortable system for holding a baby in place in the bathtub insert 10 and keeping the baby's belly warm during bathing. The comfort opening 54 is formed in the downward extending support portion 56 for the comfort of a baby, and particularly a male baby. A cover 52 is mounted to the downwardly extending support portion 56 to cover at least part of the comfort opening 54. The cover 52 is positioned and configured to deflect any urine that is excreted during the bathing process. In embodiments, the comfort opening is rectangular, and has a length in the range of about two inches to about four inches, and a width in the range of about two inches to about four inches. The comfort opening alternatively can be of another shape, such as a circle, semicircle, triangle, or other polygon.

In embodiments, the cover 52 is permanently connected to the downwardly extending support portion 56. In embodiments, the cover 52 is configured to extend downwardly and outwardly relative to the belt portion 42 of the front support 40. This configuration is shown in FIGS. 1-3. In other cases, the cover 52 is mounted to a side of the comfort opening 54. The cover 52 can be configured to be removably mounted to the downwardly extending support portion 56. In some cases, the cover 52 is mounted to the lower portion of the back support 34, or to the belt portion 42.

FIG. 1 further shows an embodiment that includes a pouch 88 on the first wall 14 and a pouch 88 on the second wall 16 to hold the side connections of the first end 44 and second end 46 of the belt portion 42 when they are not attached. The pouch 88 is a safe place to stow away loose portions of the side connections of the first end 44 and second end 46 of the belt portion 42 so that they do not tangle the baby, or sit under the baby making the baby uncomfortable during the bathing process.

FIG. 3 shows the second wall 16 of the bathtub insert 10. It also shows the connection of the back support 34 with the second wall 16, and depicts the location of the front support 40 in relation to the bathtub insert 10.

In embodiments, the shell structure 12 is formed from a water resistant or waterproof fabric, and is intended to be mounted in a baby bathtub. The shell structure 12 has dimensions suitable to support an infant therein during bathing. In embodiments, the back support 34, first wall 14 and second wall 16 are formed as a unitary, one-piece body. In the embodiment shown in FIGS. 1-3 the shell structure 12 is dimensioned such that the feet of an infant being bathed extend beyond the front edge 84 of the back support 34. The thighs of the infant rest on the lower end portion 86 of the back support 34.

In some embodiments, the back support 34 is made of a more rigid material, in which case the insert can be used in a conventional bathtub. In this case, the back support 34 may comprise a fabric-covered thermoplastic or thermoset material. A similar construction optionally can be used for the side walls.

In the embodiments shown in FIGS. 1-3, the first and second ends 44, 46 of the belt portion 42 are removably attached to the first and second walls, 14, 16, respectively. The downwardly extending support portion 56 is permanently fixed to the lower end of the back support 34. In other cases, the lower end of the downwardly extending support portion 56 is removably attached to the lower end of the back support 34. In embodiments, the first and second ends 44, 46 of the belt portion 42 are permanently attached to the first and second walls, 14, 16, respectively.

In embodiments, the belt portion 42 has an adjustable length in order to accommodate infants of various sizes. One suitable adjustable embodiment is shown in FIGS. 1-3, which includes strap adjustment brackets 83, 85 at first and second ends 44, 46 of the belt portion 42.

Figure 4:
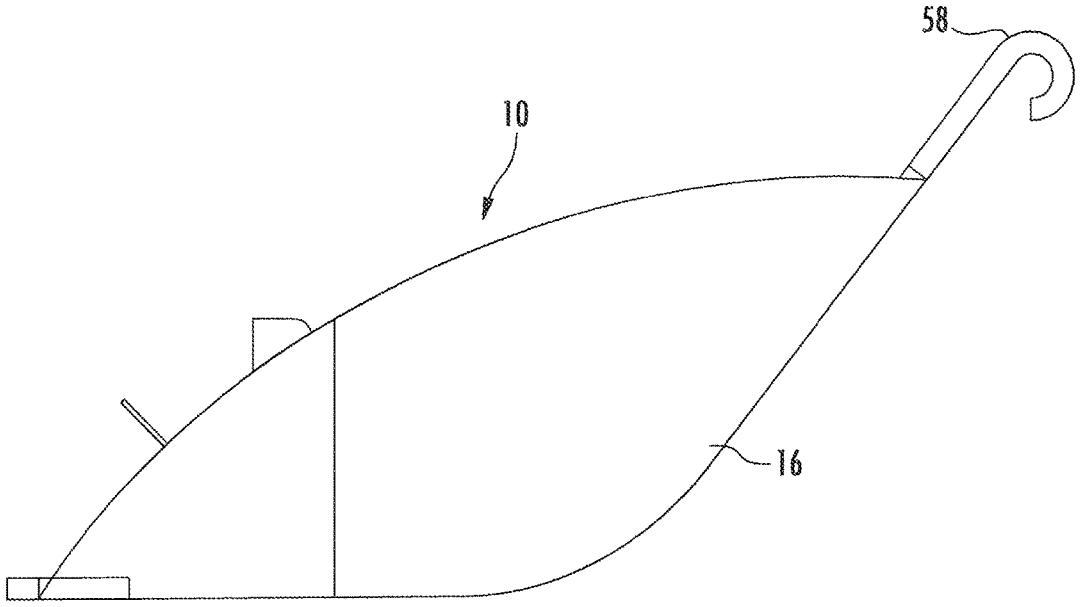
FIG. 4 shows a side view of an embodiment that includes a hook which optionally can be included with the embodiment shown in FIG. 1 to attach the bathtub insert to a bathtub.

FIG. 4 shows an embodiment that includes at least one hook 58 to attach the bathtub insert 10 to a bathtub edge. The hook 58 fits over the side edge of the bathtub edge to hold the bathtub insert 10 in place during bathing.

Figure 5:
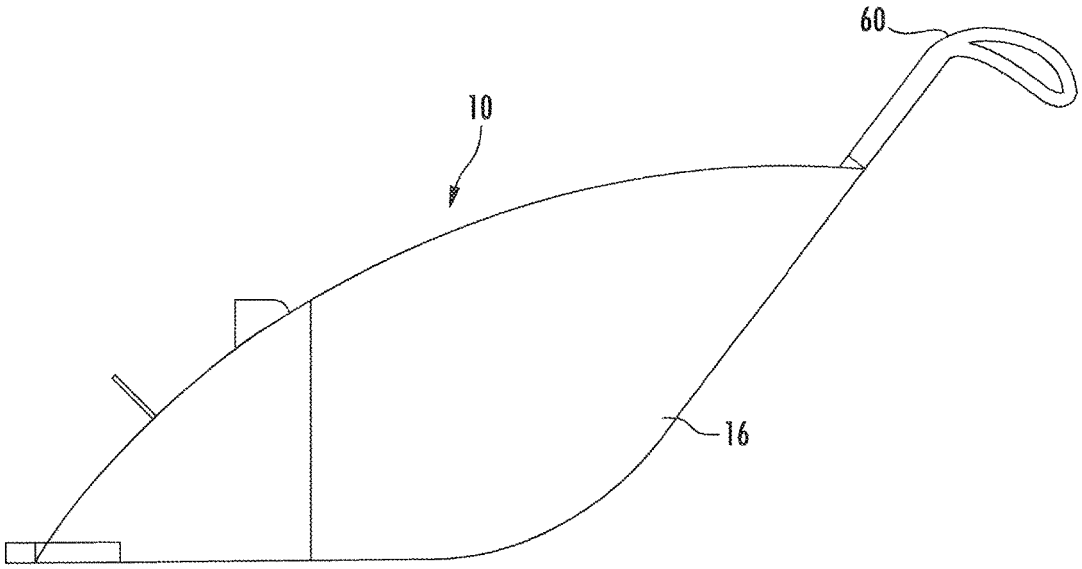
FIG. 5 shows a side view of an embodiment that includes a strap that optionally can be included with the embodiment shown in FIG. 1 to attach the bathtub insert to a bathtub.

FIG. 5 shows an embodiment that includes at least one strap 60 to attach the bathtub insert 10 to a bathtub. The strap 60 is adapted to fit around a portable bathtub frame. This strap 60 may also be used in conjunction with a hook to secure the bathtub insert 10 to a bathtub.

Figure 6:
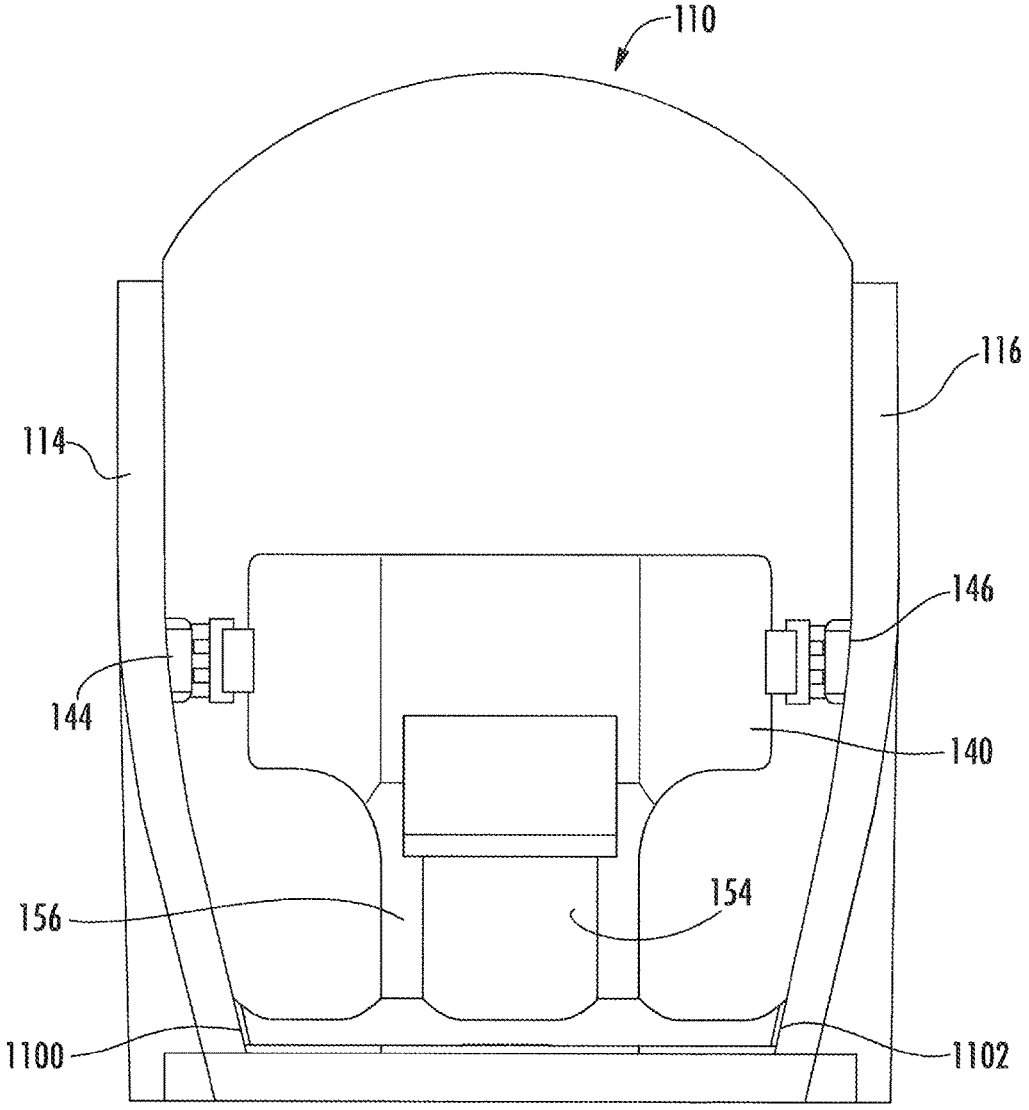
FIG. 6 shows a front view of an embodiment in which the front support of the bathtub insert is connected to the first and second walls with fasteners.

FIG. 6 shows an embodiment 110 where the downwardly extending support portion 156 with comfort opening 154 is connected to the first wall 114 and the second wall 116 instead of the back support as shown in previous embodiments. In this case, the structure is simplified relative to the embodiment shown in FIGS. 1-3, enabling more efficient manufacture. The front support 140 is connected to the first wall and the second wall 114, 116 with any one of a set of fasteners 1100 and 1102 from the set including, a set of magnets, a set of latches, and a set of hook and loop fasteners.

Figure 7:
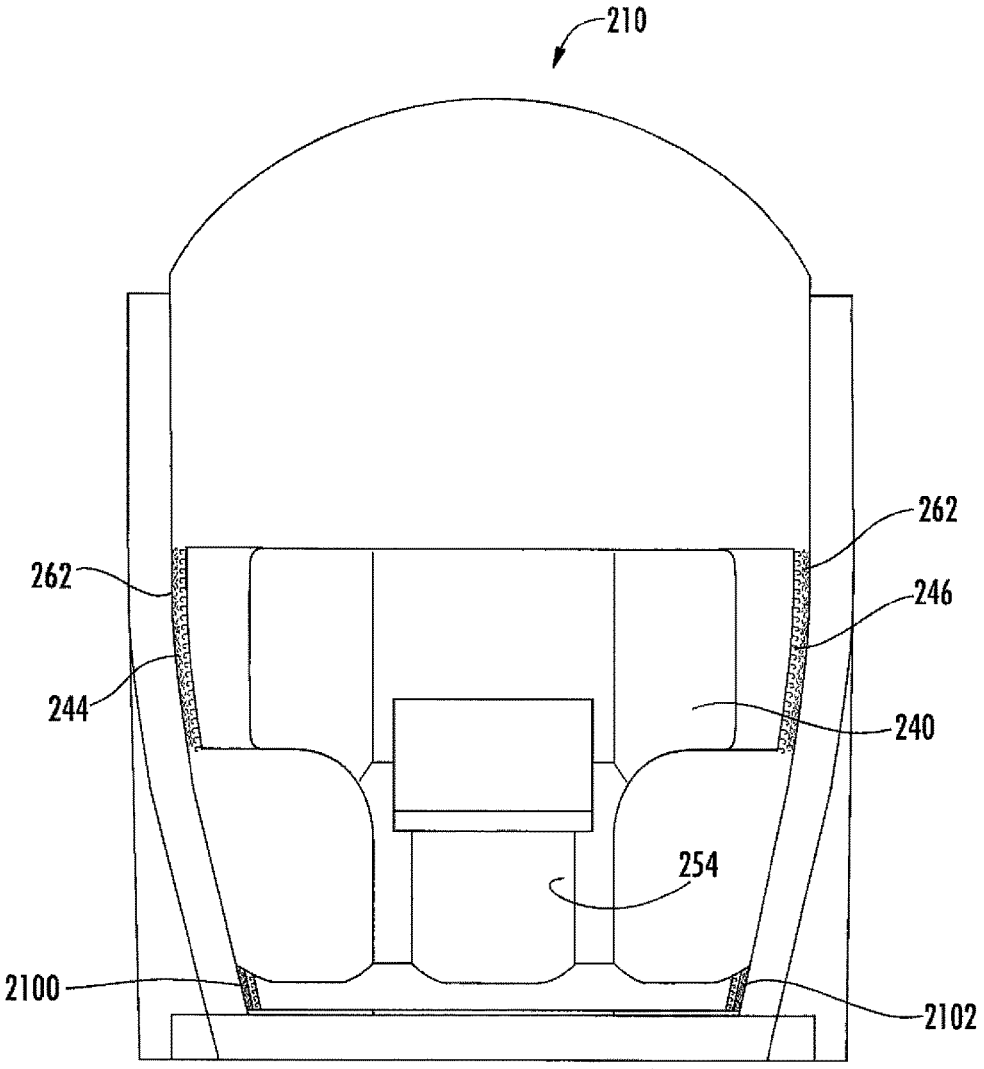
FIG. 7 shows a front view of an embodiment in which the front support of the insert is connected to the first and second walls with a hook and loop fastener.

FIG. 7 shows an embodiment 210 where the first end 244 and the second end 246 of the belt portion of the front support 240 connect to the first wall and the second wall with a hook and loop fastener 262. The embodiment includes upper attachments, which are formed on the first and second ends of the belt portion 244, and 246 and lower attachments 2100 and 2102. This embodiment facilitates rapid fastening of an active baby into the bathtub insert.

Figure 8:
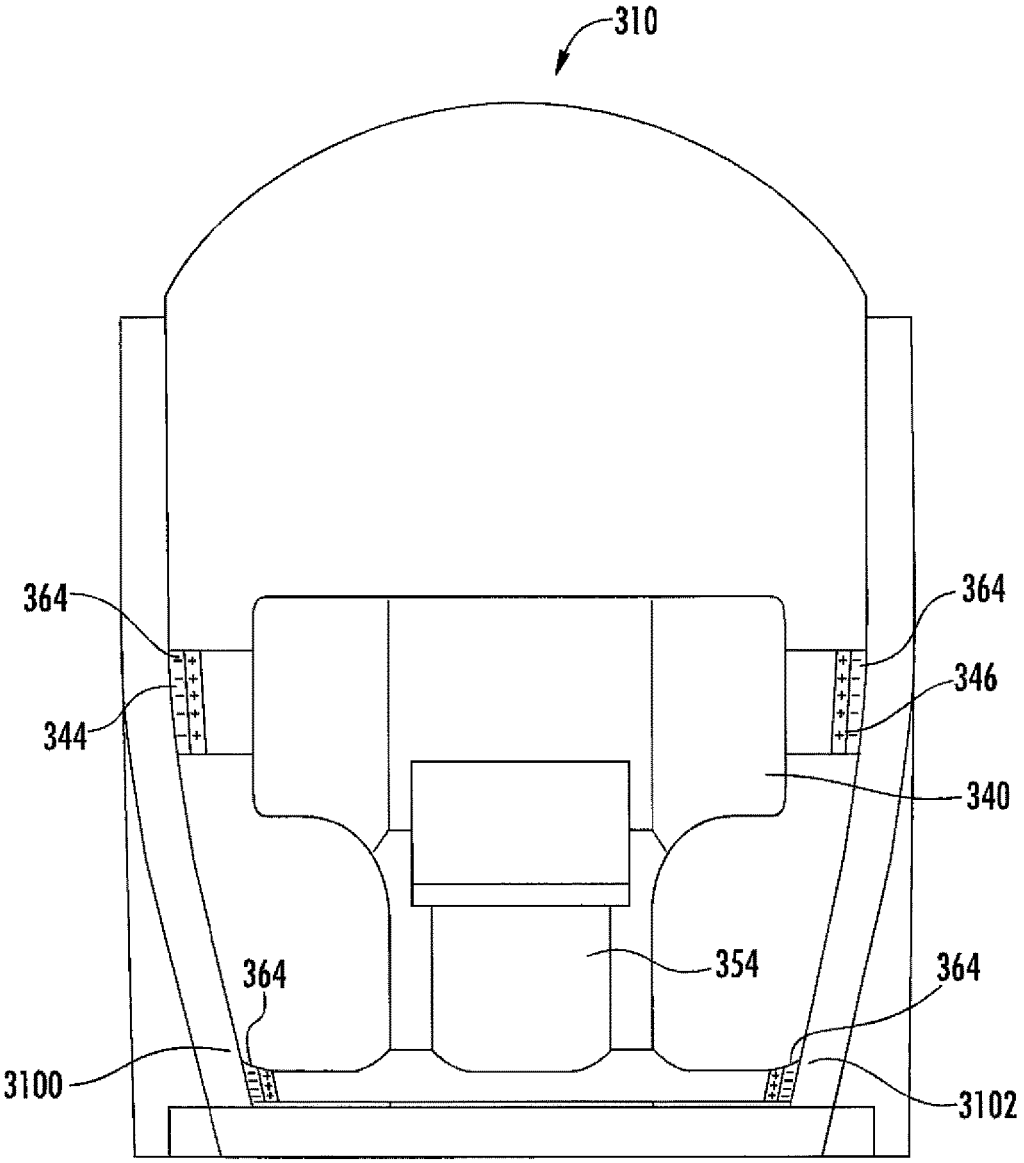
FIG. 8 shows a front view of an embodiment in which the front support of the insert is connected to the first and second walls with a set of magnets.

FIG. 8 shows an embodiment 310 where the first end 344 and the second end 346 of the belt portion of the front support 340 connect to the first wall and the second wall with at least one magnet 364. The magnets are selected to provide a sufficient degree to attraction to prevent an active baby from pulling off the support portion. This embodiment also includes a set of front support lower attachments 3100, and 3102 that comprise pairs of magnets 364.

Figure 9:
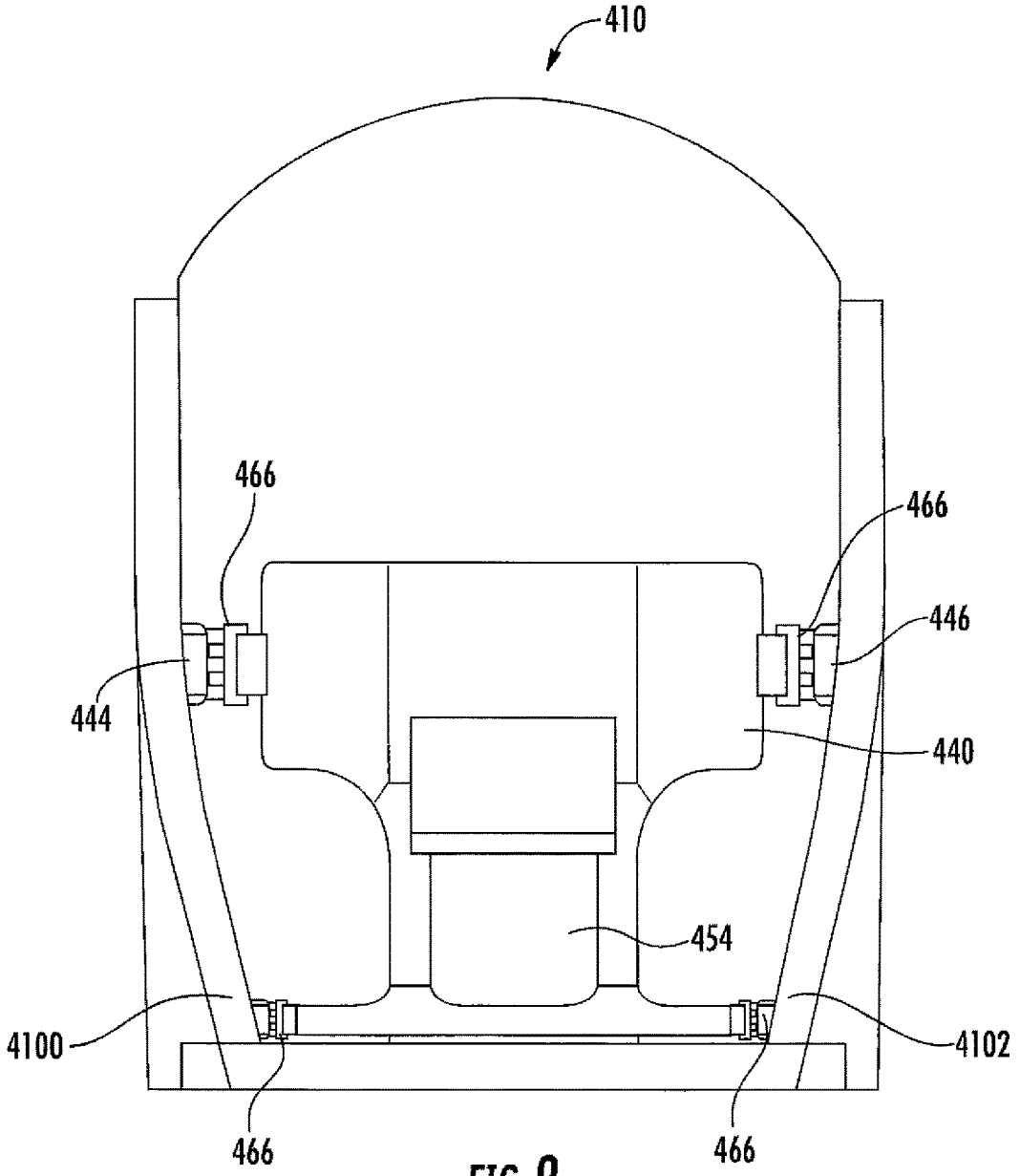
FIG. 9 shows a front view of an embodiment in which the front support of the insert is connected to the first and second walls with at least a set of latches.

FIG. 9 shows an embodiment 410 where the first end 444 and the second end 446 of the belt portion of the front support 440 connect to the first wall and the second wall with at least one set of latches 466. This embodiment also includes a set of front support lower attachments 4100, and 4102. These attachments comprise small sets of latches 466.

Figure 10:
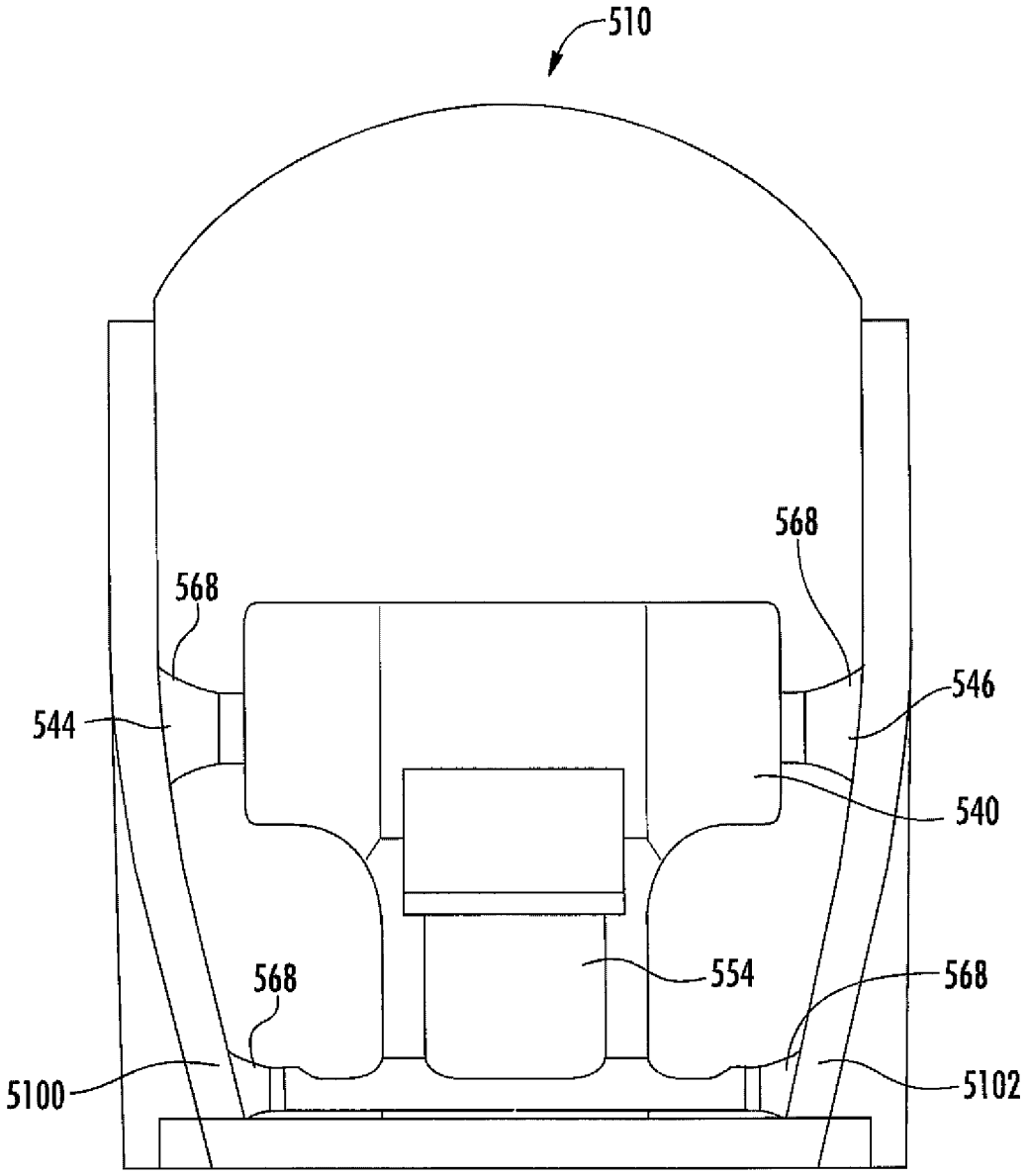
FIG. 10 shows a front view of an embodiment in which the front support of the insert is connected to the first and second walls using suction connectors.

FIG. 10 shows an embodiment 510 where the first end 544 and the second end 546 of the belt portion of the front support 540 connect to the first wall the second wall and the back support using suction connectors 568. This embodiment also includes a set of front support lower attachments 5100, and 5102. These attachments comprise small sets of suction cups 568.

Figure 11:
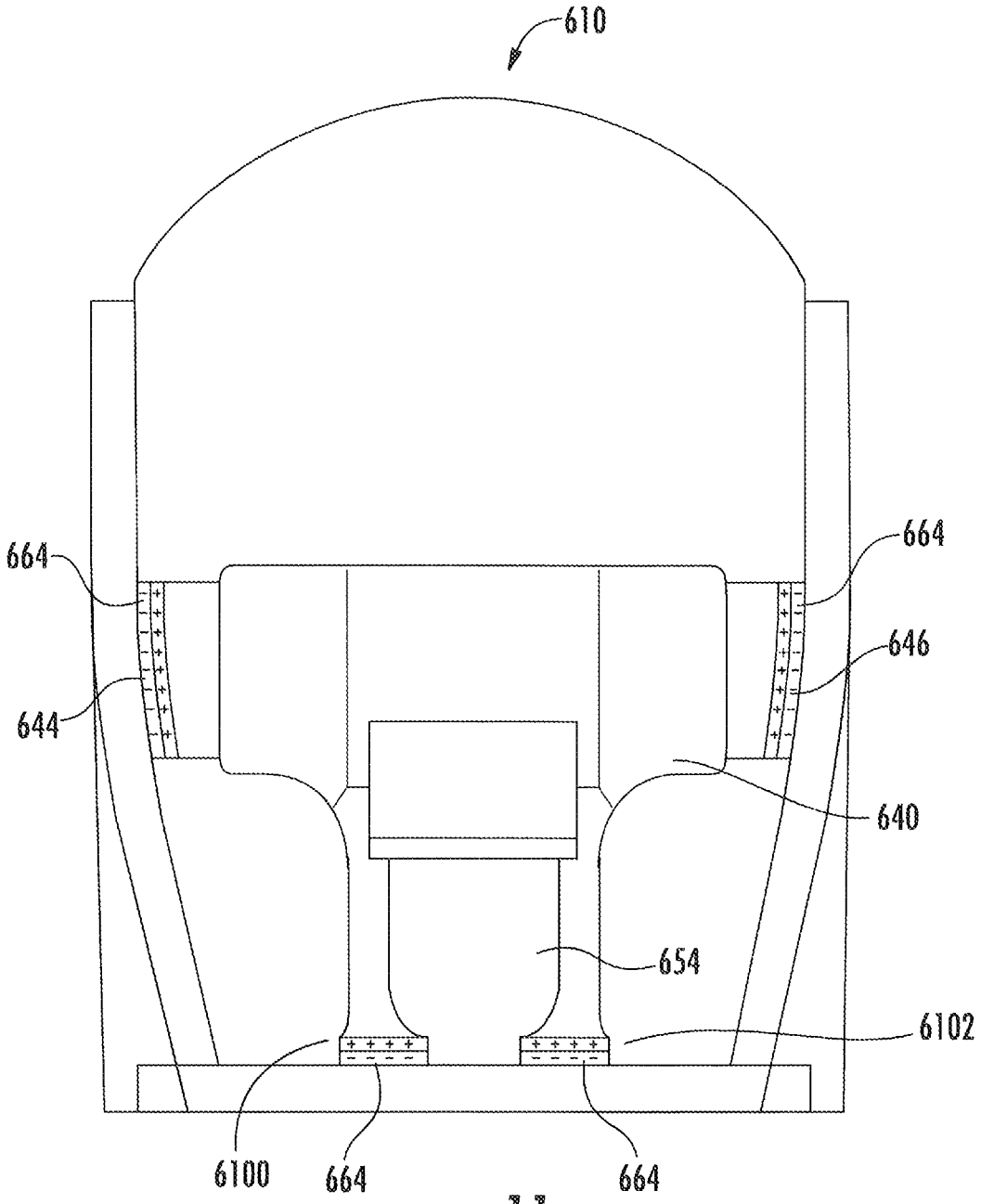
FIG. 11 shows a front view of an embodiment in which the front support of the insert is connected to the first and second walls and the back support of the insert using magnet connectors.

FIG. 11 shows an embodiment 610 where the first end 644 and the second end 646 of the belt portion of the front support 640 connect to the first wall the second wall and the back support using a set of magnets 664. The front support is connected to the back support at two points 6100 and 6102. This embodiment shows a front support 640 that includes a semi-rigid central portion with semi-rigid contouring portions on either side thereof. The semi-rigid contouring portions are attached to first and second flexible straps. This combination provides a combination of infant support and comfort, as well as adjustability to accommodate the baby as he/she grows.

Figure 12:
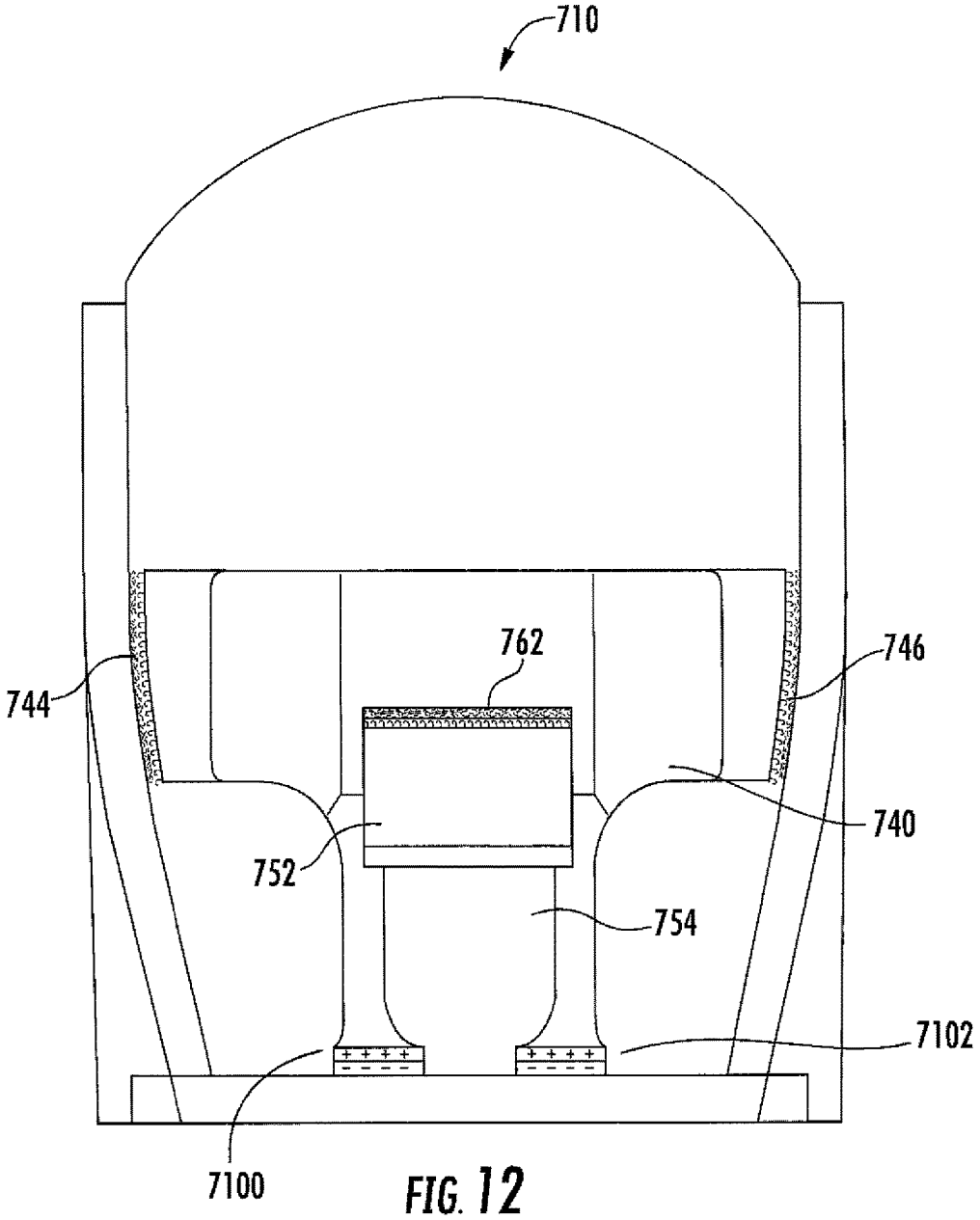
FIG. 12 shows a front view of the front support in an embodiment in which the cover is removably connected to the front support with a hook and loop fastener or a magnet.

FIG. 12 shows an embodiment 710 with a front support 740 connected to the side walls with hook and loop fasteners (as in FIG. 7) at the upper connectors 744 and 746. This embodiment uses magnet connectors at the lower end of the downwardly extending support portion to connect the front support to the back support as lower attachments 7100 and 7102 (as in FIG. 11).

Figure 13:
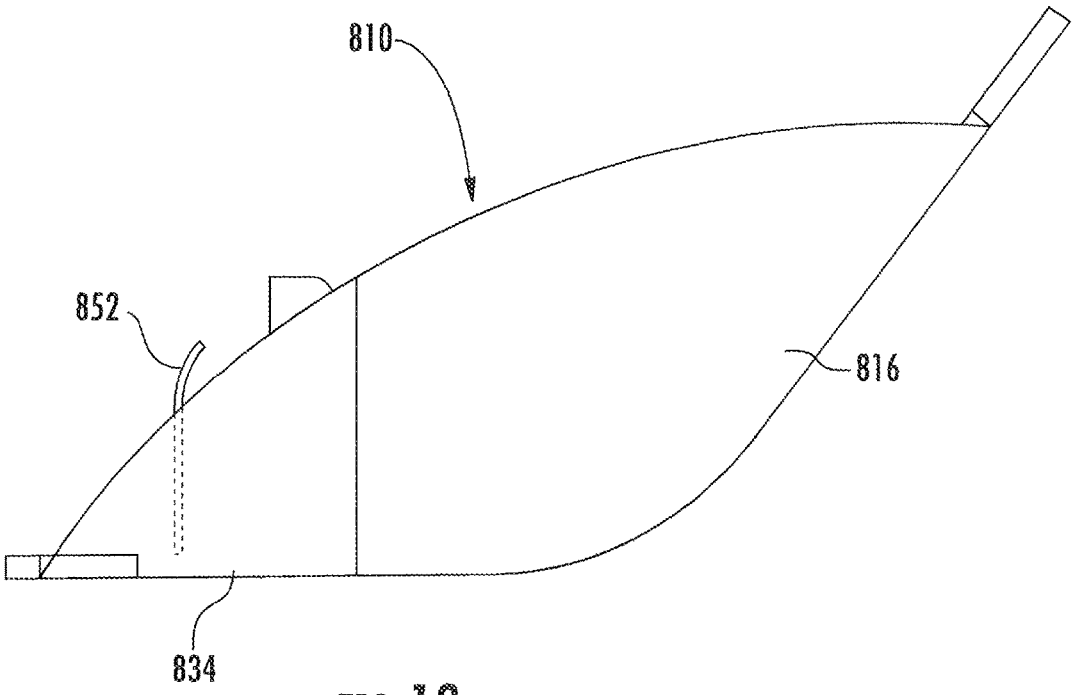
FIG. 13 shows a side view of the bathtub shell in an embodiment in which the cover is connected to the back support.

FIG. 13 shows an embodiment 810 in which the cover 852 is connected to the back support 834. In embodiments, the insert 810 has a length of twenty to twenty-eight inches, or about twenty-four inches, a width of ten to fourteen, or about twelve inches, and a depth of five to nine inches, or about seven inches. In embodiments, if the insert 810 fits into a bathtub, the insert 810 is typically made of a polyurethane material and roughly the size of a baby bathtub. In embodiments, the insert 810 may also be made of a water resistant or waterproof fabric material.

Figure 14:
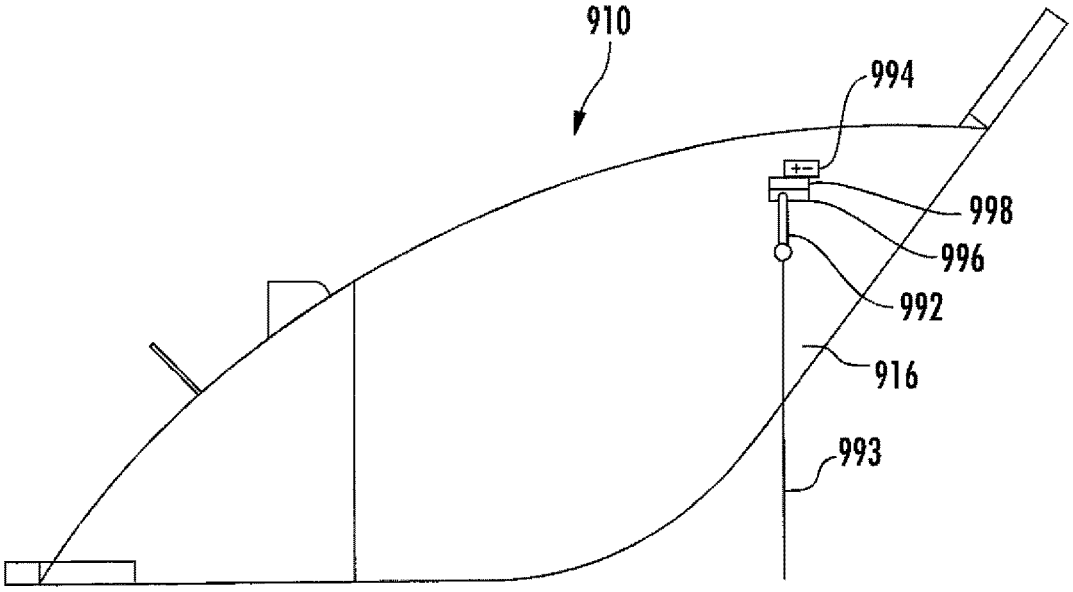
FIG. 14 shows an embodiment that includes a thermometer, speaker and light to alert the user if the water temperature is too high or low.

FIG. 14 shows a side view of an embodiment of a bathtub insert 910 that includes a thermometer 992 with a probe 993, a battery 994 a speaker 996 and a light 998 mounted on the exterior of the second wall 916. At least one of the group comprising the light 998 and the speaker 996 are activated when the thermometer 992 reaches a certain temperature as set by a bather. This allows a bather to monitor the temperature of the bath water during bathing, and notifies the bather if the bathwater exceeds intended temperatures. This will help keep a baby comfortable during bathing, and keep the baby from being burned by excessively hot water, or chilled by excessively cold water.

The bathtub insert 10 can be used to support a baby during a bath. To use the bathtub insert 10, of FIGS. 1-3 the insert 10 is placed in a conventional-sized and baby-sized bathtub in a position such that is will not slide. If an attachment mechanism is available, the bathtub insert 10 is attached to the tub. Before or after water is added, the baby is placed in the bathtub insert with his/her back against the back support 34 and his/her feet extending out in front, over the front edge 84 of the back support 34. The downwardly-extending support portion 56 of the front support 40 is attached to the back support 34 (if not permanently connected) such that the baby's tummy is supported by the front support 40. The belt portion is then strapped around the baby to hold the baby in place. If the cover 52 is not already in place, the cover 52 is mounted on the front support 40, the back support 34, or one of the side walls 14, 16 in an arrangement such that it will deflect the baby's urine during bathing and enable convenient cleaning of the baby's private areas. The baby is now ready for his/her bath. To wash the baby's back, the baby is unbuckled, a set of fasteners, if included, are tucked away in the pouch 88 connected to the first wall 14, and the pouch 88 connected to the second wall 16. The baby is turned over and placed face-down with the chest and knees resting on the back support 34. The baby's head is above the water and the arms resting on the top of either side walls. The bather now has access to clean the baby's back.

In some cases, as is shown in FIG. 12, the front support 740 includes a hook and loop fastener 762 on the belt portion 742 and the cover 752 to hold the cover 752 away from the comfort opening 754 when cleaning a baby's private area.

The bathtub insert described herein provides for infant safety and comfort, while enabling the parent or other caregiver bathing the baby to have a comfortable and worry-free experience bathing the baby. The bathtub insert further allows the parent or other care giver to utilize an existing bathtub while creating a more comfortable environment for the baby.

While the bathtub insert and methods have been described in detail herein in accordance with certain preferred embodiments thereof, many modifications and changes therein may be effected by those skilled in the art. Accordingly, it is intended by the appended claims to cover all such modifications and changes as fall within the spirit and scope of the disclosed embodiments.

What is claimed is:

1. A bathtub insert comprising:

a bathtub shell including a back support, and opposite first and second walls connected to the back support, a front support connected to the bathtub shell, the front support including a belt portion having first and second ends mounted to the shell, a downwardly extending support portion having a lower end portion configured to be positioned between the legs of an unclothed, seated baby during bathing, the lower end portion including a central comfort opening formed therein having a fixed size and shape, and, a cover mounted to the front support, the cover extending outwardly and downwardly relative to the belt portion and being configured to cover at least a part of the comfort opening.

2. The bathtub insert of claim 1 wherein the cover is permanently mounted to at least one of the downwardly extending support portion and the belt portion.

3. The bathtub insert of claim 1 wherein the cover is connected to the back support.

4. The bathtub insert of claim 1 wherein the cover is removably mounted to the belt portion with at least one of a hook and loop fastener and a magnet.

5. The bathtub insert of claim 1 wherein the downwardly extending support portion of the front support is connected to the back support.

6. The bathtub insert of claim 1 wherein the downwardly extending support portion is connected to the first wall and the second wall.

7. The bathtub insert of claim 1 wherein the first end and the second end of the belt portion connect to the first wall and the second wall with at least one fastener selected from the group consisting of hook and loop fasteners, magnets, and latches.

8. The bathtub insert of claim 1 further comprising:

a first strap connected to the back support of the bathtub insert; and a second strap connected to a front end of the bathtub insert.

9. The bathtub insert of claim 1 further comprising:

a first hook connected to the front end of the bathtub insert; and a second hook connected to a rear end of the bathtub insert.

10. The bathtub insert of claim 1 further comprising:

at least one of a speaker and a light configured to activate when a thermometer that is integrated with the bathtub insert reaches a certain temperature.

11. A method of supporting an infant prior to bathing comprising:

placing an infant in the bathtub insert of claim 1 with their back in contact with the back support and their tummy in contact with the front support.

12. The bathtub insert of claim 1 wherein:

the comfort opening is configured such that the downwardly extending support portion does not directly contact genitalia of the unclothed, seated baby.

13. The bathtub insert of claim 1 wherein:

the cover is positioned to deflect urine during bathing.

* * * * *